US005655173A

United States Patent [19]

Hirai et al.

[11] Patent Number: 5,655,173

[45] Date of Patent: Aug. 5, 1997

[54] IMAGE FORMING APPARATUS

[75] Inventors: Masashi Hirai, Katano; Hirokazu Yamauchi, Uji, both of Japan

[73] Assignee: Sharp Kabushiki Kaisha, Osaka, Japan

[21] Appl. No.: 614,825

[22] Filed: Mar. 7, 1996

[30] Foreign Application Priority Data

Mar. 7, 1995 [JP] Japan ..... 7-047512

[51] Int. Cl.[6] ..... G03G 21/00

[52] U.S. Cl. ..... 399/21; 399/124; 399/402

[58] Field of Search ..... 399/21, 402, 124

[56] References Cited

U.S. PATENT DOCUMENTS

| | | | |
|---|---|---|---|
| 4,734,744 | 3/1988 | Yamamoto | 399/21 |
| 4,849,796 | 7/1989 | Murakami | 399/21 |
| 4,864,368 | 9/1989 | Muramatsu | 399/402 |
| 5,134,443 | 7/1992 | Sumi et al. | 399/121 |
| 5,191,383 | 3/1993 | Watanabe | 399/124 |
| 5,293,203 | 3/1994 | Wada et al. | 399/124 |

FOREIGN PATENT DOCUMENTS

| | | |
|---|---|---|
| 3-67872 | 3/1991 | Japan . |
| 4-283764 | 10/1992 | Japan . |
| 5-139629 | 6/1993 | Japan . |

*Primary Examiner*—Nestor R. Ramirez

[57] ABSTRACT

An image forming apparatus has a jam sensor for detecting a jammed sheets in a transporting path, a paper guide which can be switched between a close state that guides sheets to an image forming section and an open state that make a jammed sheet removable, a movable backward end plate which is provided on an ADU tray and regulates a position of stored sheets according to the size of sheet, and a pulse motor that moves the movable backward end plate. When the paper guide is converted to the open state, an interference section where the movable backward end plate contacts with the paper guide and a non-interference section are formed. The image forming apparatus is provided with a CPU which drives the pulse motor so as to move the movable backward end plate to the non-interference section based upon a jam detecting signal from the jam sensor. As a result, even when the ADU tray is provided to a position where the movable backward end plate interferes with the paper guide, the paper guide can be brought to the open state while contact between the paper guide and the movable backward end plate is being avoided. Therefore, the apparatus can be small and its cost can be decreased.

16 Claims, 15 Drawing Sheets

IMAGE FORMING APPARATUS

FIELD OF THE INVENTION

The present invention relates to an image forming apparatus which has a sheet feeding unit and is used for a copying apparatus, a printer, etc., in which double-sided copying, etc. is possible. Such a sheet feeding unit is provided with a sheet guiding member, which forms a part of a transporting path and is capable of changing between a close state that guides a sheet transported through the transporting path to an image forming section and an open state that makes a jammed sheet removable in the transporting path, and provided with an intermediate tray for temporarily storing sheets discharged from the image forming section so that the sheets are again transported to the image forming section through the transporting path.

BACKGROUND OF THE INVENTION

As shown in FIG. 13, a copying apparatus as a conventional image forming apparatus is usually provided with a copy image forming section 101 in its upper portion and a sheet feeder 102 for storing new sheets in its lower portion. In such a copying apparatus, sheets are transported through a transporting path 103 which is extended from the sheet feeder 102 to the copy image forming section 101.

In order to easily remove jammed sheets when jam occurs, the transporting path 103 is provided with a paper guide 104 which can switch between a close state and an open state.

In addition, a recent copying apparatus is provided with an ADU (Automatic Duplex Unit) tray 105 as an intermediate tray which makes double-sided copying possible in a middle-stage region between the copy image forming section 101 and the sheet feeder 102.

The ADU tray 105 is provided with a movable backward end plate 106. The movable backward end plate 106 is freely movable so as to regulate sheets in a position according to a size of the sheets when the sheets discharged from the copy image forming section 101 are temporarily stored on the ADU tray 105.

Therefore, the ADU tray 105 is provided enough below the paper guide 104 so that the movable backward end plate 106 does not contact and interfere with the paper guide 104 when the paper guide 104 is converted to the open state.

In addition, as shown in FIG. 14, an image forming apparatus, in which an ADU tray 204 can be pulled out on guide rails 205 provided in the main body and the paper guide 104 is converted to the open state after removal of the ADU tray 204, is suggested as another conventional example.

However, in such a conventional image forming apparatus, the ADU tray 105 is provided enough below the paper guide 104 so that the movable backward end plate 106 of the ADU tray 105 does not contact with the paper guide 104 which is in the open state. As a result, the apparatus becomes large and its cost becomes higher.

In addition, the movable backward end plate 106 of the ADU tray 105 should be enough high for a curled sheet, so higher movable backward end plate 106 is advantageous. Moreover, the more larger moving space of the paper guide 104 between the open state and the close state becomes, the higher the operability of jam removal becomes. Therefore, there arises a problem that the apparatus becomes larger.

In addition, in the case of an apparatus shown in FIG. 14, the paper guide 104 can be brought to the open state after the ADU tray 204 is once pulled out to the front side along the guide rails 205. For this reason, in the case where sheets are jammed across the ADU tray 204 and the main body, there arises a problem that the jammed sheets are damaged or the ADU tray 204 cannot be pulled out when a jammed sheet is removed.

In addition, the method in which the movable backward end plate 106 is automatically moved by a CPU has a problem that the movable backward end plate 106 cannot be moved when the power source is off or the CPU, etc. has a defect.

Furthermore, when the ADU tray 104 is mounted with the paper guide 102 being in the open state, the movable backward end plate 106, which is interlocked by the paper guide 102, might be damaged.

In addition, when the ADU tray 104 is pulled out with the paper guide 102 being in the open state, the movable backward end plate 106, which is interlocked by the paper guide 102, might be damaged.

SUMMARY OF THE INVENTION

It is the first object of the present invention to provide an image forming apparatus for forming a plurality of images on a sheet, where a sheet guiding member can be brought to an open state while contact between the sheet guiding member and a sheet regulating member on an intermediate tray is being avoided.

In order to achieve the above first object, the image forming apparatus of the present invention is characterized by having an image forming section for forming an image on a sheet, a transporting path where sheets are transported, a jam sensor (jam detecting means) for detecting occurrence of jam of sheets in the transporting path, a sheet guiding member which composes a part of the transporting path and which can be switched between a close state that guides sheets transported through the transporting path to the image forming section and an open state that make a jammed sheet removable in the transporting path, an intermediate tray for temporarily storing sheets discharged from the image forming section so that the sheets pass through the transporting path and are transported to the image forming section again, a sheet regulating member which is provided perpendicular to the intermediate tray so that a position of the stored sheets are regulated according to the size of the sheets and that the sheet regulating member can move between an interference section where it contacts with the sheet guiding member in the open state and a non-interference section where it does not contact with the sheet guiding member in the open state, a motor (moving means) for moving the sheet regulating member to the regulated position according to the size of a sheet, and a CPU (interference control means) for controlling the motor based upon a jam detecting signal from the jam detecting sensor so as to move the sheet regulating member from the regulated position to the non-interference section.

In accordance with the above arrangement, when jam of sheets occurs in the transporting path, the CPU drives the motor so as to move the sheet regulating member to the noninterference section based upon a jam detecting signal from the jam sensor.

Therefore, when the sheet guiding member is converted from the close state to the open state in order to remove a jammed sheet, the sheet regulating member on the intermediate tray exists in the non-interference section. As a result, since the obstacle is removed, the sheet guiding member can be brought from the close state to the open state without any difficulty, thereby making it possible to easily remove a jammed sheet.

As a result, even when the intermediate tray is provided to a position where the sheet regulating member on the intermediate tray interferes with the sheet guiding member, the sheet guiding member can be brought to the open state. Therefore, the apparatus can be small, and its cost can be decreased.

It is the second object of the present invention to provide an image forming apparatus for forming a plurality of images on a sheet, where a sheet guiding member can be brought to an open state even if the sheet guiding member contacts with a sheet regulating member on an intermediate tray and where jam can be securely removed without damaging the sheet regulating member when a power source is off.

In order to achieve the above second object, the image forming apparatus of the present invention has an image forming section for forming an image on a sheet, a transporting path where sheets are transported, a sheet guiding member which composes a part of the transporting path and which can be switched between a close state that guides sheets transported through the transporting path to the image forming section and an open state that make a jammed sheet removable in the transporting path, an intermediate tray for temporarily the storing sheets discharged from the image forming section so that the sheets pass through the transporting path and are transported to the image forming section again, and a sheet regulating member which is provided perpendicular to the intermediate tray so that a position of the stored sheets are regulated according to the size of the sheets and that it contacts with the sheet guiding member in the open state at least in a part of its moving area. The image forming apparatus is characterized in that the sheet regulating member can be bent so that obstruction of the movement of the sheet guiding member is removed.

In accordance with the above arrangement, since the sheet regulating member can be freely bent, even when the sheet regulating member exists in the interference section, obstruction of the movement of the sheet guiding member due to the contact with the sheet regulating member is avoided by bending the sheet regulating member, thereby making it possible to convert the sheet guiding member to the open state.

Therefore, even if the intermediate tray is provided to a position where the sheet regulating member on the intermediate tray interferes with the sheet guiding member, the sheet guiding member can be brought to the open state. Therefore the apparatus can be small and its cost can be decreased.

It is the third object of the present invention to provide an image forming apparatus for forming a plurality of images on a sheet, where a sheet regulating member can be pulled out or mounted without damaging the regulating member.

In order to achieve the above third object, the image forming apparatus of the present invention is characterized by having an image forming section for forming an image on sheets, a transporting path where sheets are transported, a sheet guiding member which composes a part of the transporting path and which can be switched between a close state that guides sheets transported through the transporting path to the image forming section and an open state that make a jammed sheet removable in the transporting path, an intermediate tray which can be freely pulled out and which temporarily stores the sheets discharged from the image forming section so that the sheets pass through the transporting path and are transported to the image forming section again, and a sheet regulating member which regulates a position of the stored sheets according to the size of the sheets and which is provided perpendicular to said intermediate tray so that it is movable and that it contacts with said sheet guiding member in the open state at least in a part of its moving area, and prohibition means for prohibiting the intermediate tray from being pulled out or mounted when the sheet guiding member is in the open state.

In accordance with the above arrangement, since the prohibition means prohibits the intermediate tray in the open state from being pulled out or being mounted, the sheet regulating member contacts with the sheet guiding member due to pulling-out or mounting of the intermediate tray, thereby making it possible to prevent each member from being damaged.

For fuller understanding of the nature and advantages of the invention, reference should be made to the ensuing detailed description taken in conjunction with the accompanying drawings.

BRIEF DESCRIPTION OF THE DRAWINGS

FIG. 11(*a*) is a partial front view; and FIG. 11(*b*) is a side view.

FIG. 12(*a*) is a partial front view; and FIG. 12(*b*) is a side view. FIGS. 12(*c*) and 12(*d*)

are explanatory drawings which shows a relationship between the paper guide in the open state and the movable backward end plate in the image forming apparatus: FIG. 12(*c*) is a perspective view; and FIG. 12(*d*) is a side view.

DETAILED DESCRIPTION OF THE PREFERRED EMBODIMENTS

[EMBODIMENT 1]

The following explains one embodiment of the present invention in reference to FIGS. 1 through 6.

Figure 1:
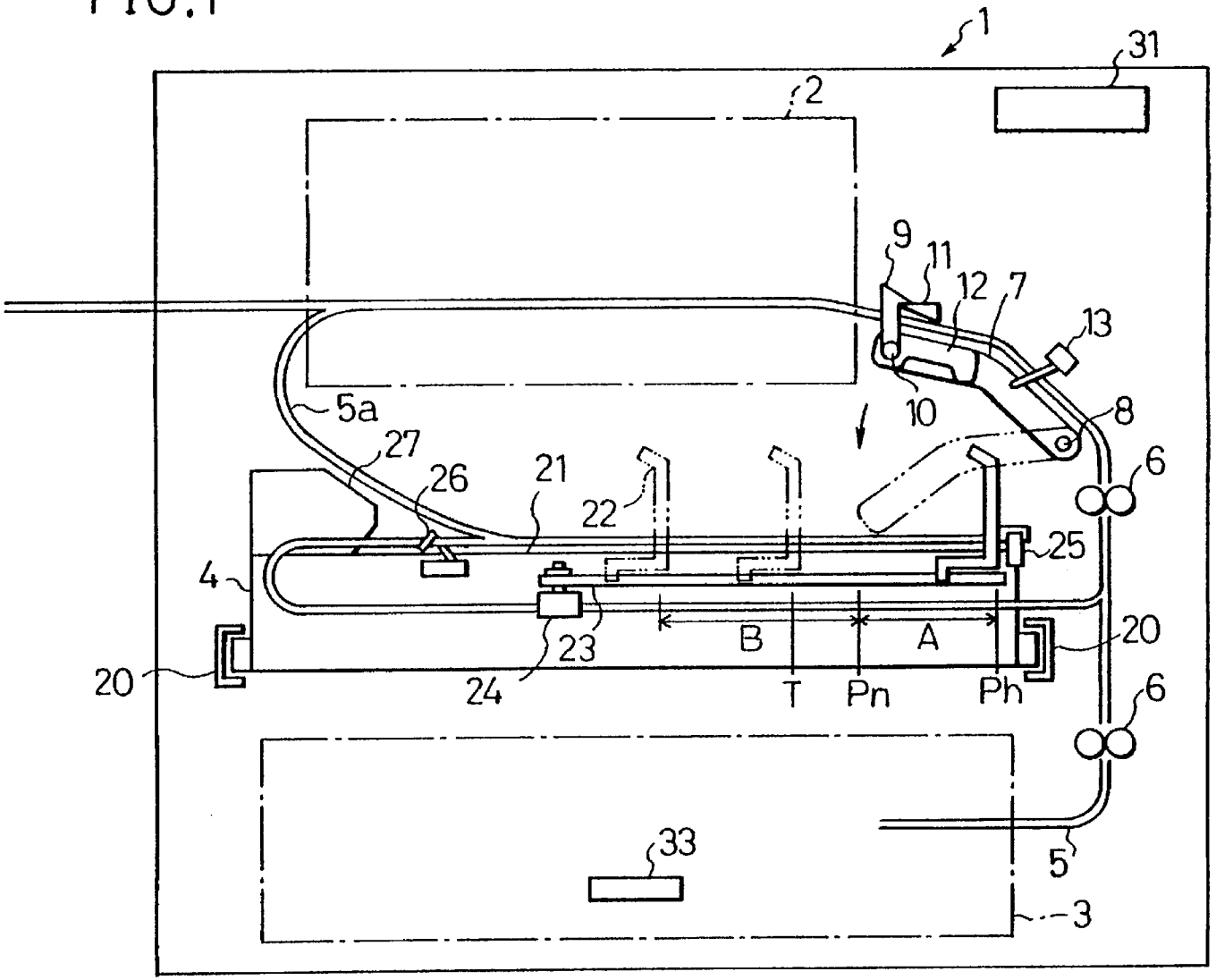
FIG. 1 is an overall view which shows a copying apparatus as an image forming apparatus according to one embodiment of the present invention.

As shown in FIG. 1, a copying apparatus as an image forming apparatus of the present embodiment has an image forming section 2 in the upper part of a main body 1, and a sheet feeder 3 for feeding sheets in the lower part. Moreover, an ADU (Automatic Duplex Unit) tray 4 as an intermediate tray, which temporarily stores sheets where one-side recording was carried out at the time of double-side copying, is provided between the image forming section 2 and the sheet feeder 3.

In order to form a transporting path 5 where sheets are transported from the sheet feeder 3 to the image forming section 2, transporting rollers 6 and a paper guide 7 as a sheet guiding member are provided to the side part of the unit main body 1. The paper guide 7 is provided just in the preceding stage of the image forming section 2, and it can be freely rotated about a supporting point 8 at its one end. Moreover, a lock claw 9 is provided at the other end of the paper guide 7 so as to be freely rotated about its rotary axis 10, and the lock claw 9 can be hooked on a receiving section 11 of the main body 1.

When the lock claw 9 is hooked on the receiving section 11, the paper guide 7 is converted to the close state that guides sheets to the image forming section 2. Meanwhile, when a lever 12 provided to the rotary axis 10 is manually rotated so that the lock claw 9 is released from the receiving section 11, the paper guide 7 is rotated downward about the supporting point 8 by its weight. As a result, the paper guide 7 is converted to the open state for removing jammed sheets. Moreover, the paper guide 7 can be brought from the open state to the close state by raising the lever 12.

In such a manner, the paper guide 7 can be switched between the close state for guiding sheets, which are transported through the transporting path 5, to the image forming section 2 and the open state for taking out sheets jammed in the transporting path 5. Here, in order to detect jam, a jam sensor 13 as jam detecting means is provided in the vicinity of the paper guide 7.

Meanwhile, the transporting path 5 is extended up to the other side section of the main body 1 so that after sheets pass through the image forming section 2, the sheets where copying was carried out are discharged. A branch transporting path 5*a*, which is branched at the end of the image forming section 2, leads to the ADU tray 4.

The ADU tray 4 can be freely pulled out to the front side in FIG. 1 along the guide rails 20 provided to the both ends of the main body 1, and it is detachable.

A storage table 21 is provided above the ADU tray 4. Sheets, on which copying was carried out in the image forming section 2, are transported to the storage table 21 through the branch transporting path 5*a* so as to be stored on the storage table 21. A movable backward end plate 22 as a sheet regulating member is mounted perpendicular to the storage table 21 in the transporting forward end direction of the storage table 21 (the right side in FIG. 1). Since the movable backward end plate 22 is provided so as to be movable in the lateral direction in FIG. 1, it regulates the position of the sheets which were transported to the storage table 21 and stored thereon. In other words, the movable backward end plate 22 is movable according to sizes of sheets stored on the ADU tray 4, namely, between the position according to the minimum size of a sheet and the position according to the maximum size of a sheet. When a driving belt 23, which is linked to the lower end of the movable backward end plate 22, is driven by a pulse motor 24 as moving means, the movable backward end plate 22 is moved. Moreover, a size of sheets is detected by a size detecting sensor 33 provided to the sheet feeder 3.

A home position sensor (i.e. "HP sensor") 25, which detects whether the movable backward end plate 22 is in the home position "Ph", is provided to the end of the ADU tray 4 so as to correspond to the maximum size of sheets.

In addition, a sheet detecting sensor 26, which detects whether sheets exist on the ADU tray 4, is provided to the storage table 21.

Furthermore, the movable backward end plate 22 is formed so as to be higher than the maximum sheet storing height, and its upper end section is bent. Therefore, even in the case where the stored sheets are warped, the sheets are not stuck out from the movable backward end plate 22.

The sheets stored on the ADU tray 4 are transported below the storage table 21 to the transporting path 5, and are again supplied to the image forming section 2.

Figure 2:
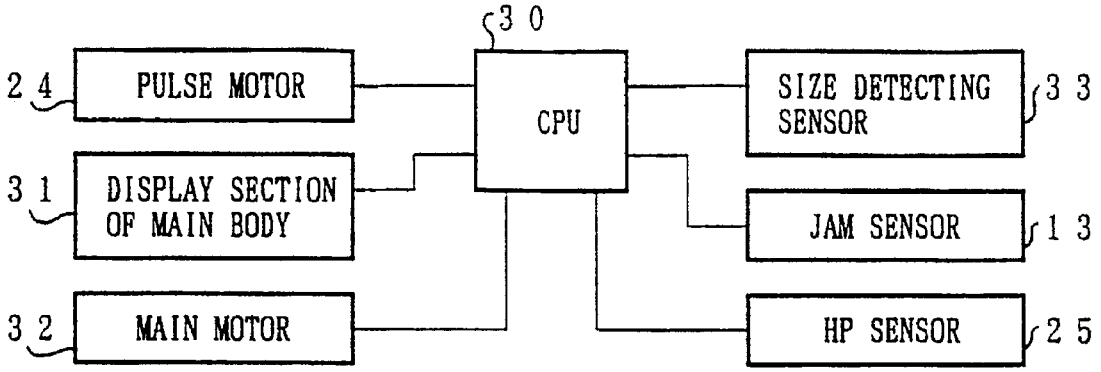
FIG. 2 is a block diagram which shows the constitution of a control section that controls a sheet feeder in the image forming apparatus.

Meanwhile, as shown in FIG. 2, sheet feeding control, such as movement of the movable backward end plate 22 and the other driving control, is exercised by a CPU (Central Processing Unit) 30 as interference controlling means. In other words, the pulse motor 24, a main body display section (display means) 31, a main motor 32, the size detecting sensor 33, the jam sensor 13, the HP sensor 25, etc. are connected to the CPU 30. The CPU 30 controls each section during the usual sheet feeding operation of the image forming apparatus and also when jam occurs.

The main body display section 31 is provided in the upper part of the main body 1 (see FIG. 1). The main body display section 31 displays a sheet size, which is detected by the size detecting sensor 33 provided to the sheet feeder 3, occurrence of jam, etc.

The main motor 32 drives the transporting rollers 6 of the transporting path 5.

In addition, the CPU 30 controls the position of the movable backward end plate 22 by an output signal from the HP sensor 25 and the pulse motor 24.

The following describes the usual sheet feeding operation of the image forming apparatus having the above arrangement.

As shown in FIG. 1, unused sheets stored in the sheet feeder 3 are transported to the image forming section 2 through the transporting path 5. In the image forming section 2, an image is formed and fixed on the sheets. Thereafter, the sheets are discharged out of the main body 1.

Meanwhile, in the case of a double-sided copying, etc., sheets through the image forming section 2 pass through the branch transporting path 5*a* and are transported to the ADU tray 4. Then, the sheets are temporarily stored on the storage table 21. At this time, in order to store the sheets regularly, the size detecting sensor 33 in the sheet feeder 3 detects the size of the sheets and the CPU 30 moves the movable backward end plate 22 to a position according to the size of the sheets. As a result, the ends of the sheets are regulated by the movable backward end plate 22 so that the sheets are arranged in the refeeding position.

After being stored on the ADU tray 4, the sheets are transported from the ADU sheet feeder 27 to the transporting path 5 by an instruction of the CPU 30 and are again fed to the image forming section 2. An image is formed on the rear faces or the same faces of the sheets, and the sheets are discharged out of the main body 1.

In a conventional manner, in the case where the paper guide 7 is converted to the open state due to occurrence of jam, when the movable backward end plate 22 of the ADU tray 4 is put in an interference section "A" shown in FIG. 1, the paper guide 7 contacts with the movable backward end plate 22. It disturbs the rotatory movement of the paper guide 7 to the open state. However, in the sheet feeder of the present embodiment, in order to avoid the contact between the paper guide 7 and the movable backward end plate 22 by means of the control of the CPU 30 as interference control means, the movable backward end plate 22 is moved to a non-interference section "B".

In other words, as shown in FIG. 1, when jam occurs, the CPU 30 stops the usual image forming operation based upon the jam detecting signal of the jam sensor 13, and moves the movable backward end plate 22 in the interference section "A" forward to the non-interference section "B".

In addition, just after the movable backward end plate 22 is moved to the non-interference section "B", the CPU 30 displays the occurrence of jam on the main body display section 31. As a result, a user can convert the paper guide 7 to the open state without any difficulty, so the user make a jammed sheet removable.

Figure 3:
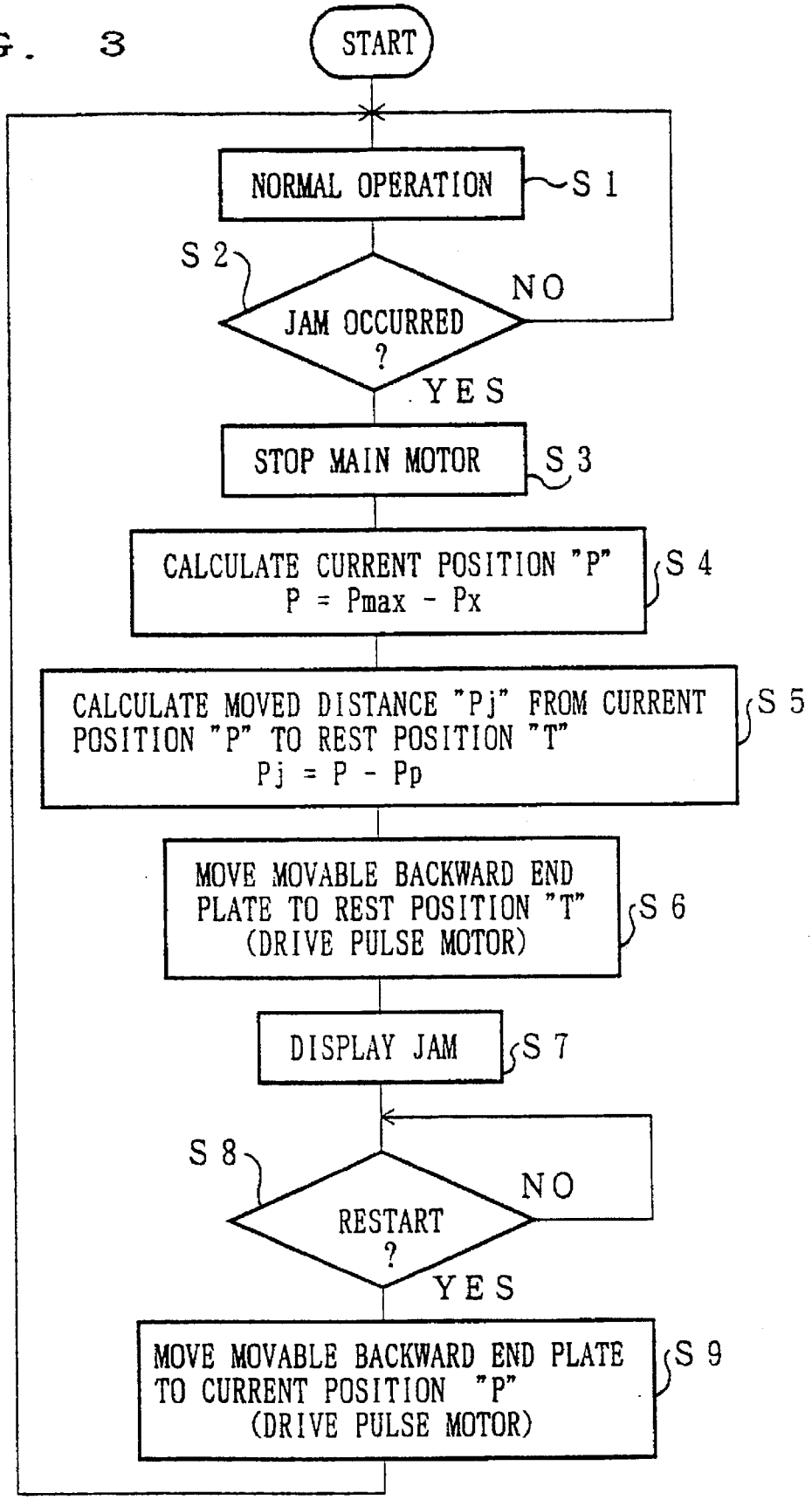
FIG. 3 is a flow chart which shows control for moving a movable backward end plate by a CPU in the image forming apparatus.

The following describes the control of the movement of the movable backward end plate 22 by the CPU 30 in reference to the flow chart shown in FIG. 3.

The CPU 30 control the usual operation (S1) and always monitors occurrence of jam (S2). If jam occurs, the CPU 30 stops the main motor 32 for driving the transporting rollers 6 (3).

Then, the CPU 30 calculates a current position "P" of the movable backward end plate 22 based upon the home position "Ph" (S4). When the home position "Ph" is the origin (O), the current position "P" is calculated as follows:

$$P=Pmax-Px,$$

where Pmax is a length of a sheet having maximum size and Px is a length of a sheet on which an image is going to be copied. The present embodiment illustrates the case where the position according to the length "Pmax" of a sheet having maximum size agrees with the home position "Ph".

Next, the CPU 30 calculates a moved distance "Pj" from the current position "P" to a rest position "T" in the non-interference section "B" (S5). The moved distance "Pj" is calculated as follows:

$$Pj=p-Pp,$$

where Pp is a distance from a position according to a length "Pmax" of a sheet having maximum size to the rest position "T". Here, when "Pj" is negative, the movable backward end plate 22 is moved away from the home position "Ph", and when "Pj" is positive, the movable backward end plate 22 is moved closer to the home position "Ph".

Next, the CPU 30 drives the pulse motor 24 so as to move the movable backward end plate 22 from the current position "P" to the rest position "T" in the noninterference section "B" based upon the calculation of the moved distance "Pj" (S6). Thereafter, occurrence of jam is displayed on the main body display section 31 (S7). As a result, the user recognizes that jam has occurred, and the user turns the lever 12 of the paper guide 7 so that the lock claw 9 is released from the receiving section 11. As a result, the paper guide 7 is converted to the open state. At this time, since the movable backward end plate 22 is moved to the non-interference section "B", the paper guide 7 is in the open state without contacting with the movable backward end plate 22. Then, the user takes out a jammed sheet in the transporting path 5 above the ADU tray 4. Thereafter, the user pushes the lever 12 up so that the lock claw 9 is hooked on the receiving section 11. As a result, the paper guide 7 is converted to the close state, and the operation can be restarted.

The CPU 30 judges as to whether the operation can be restarted (S8), and when it judges that the operation can be restatted after a restart signal is inputted, the CPU 30 moves the movable backward end plate 22 to the current position "P" (S9).

Even if jam occurs and the movable backward end plate 22 is in the interference section "A" of the paper guide 7, the movable backward end plate 22 can be moved to the non-interference section "B" by the CPU 30, and thus a jammed sheet can be easily removed.

In the above control, when sheets have been already stored on the ADU tray 4, the movable backward end plate 22 is occasionally put to the interference section "A" according to a sheet size. It becomes a problem that the movable backward end plate 22 should be moved to the rest position "T" in the non-interference section "B".

Figure 4:
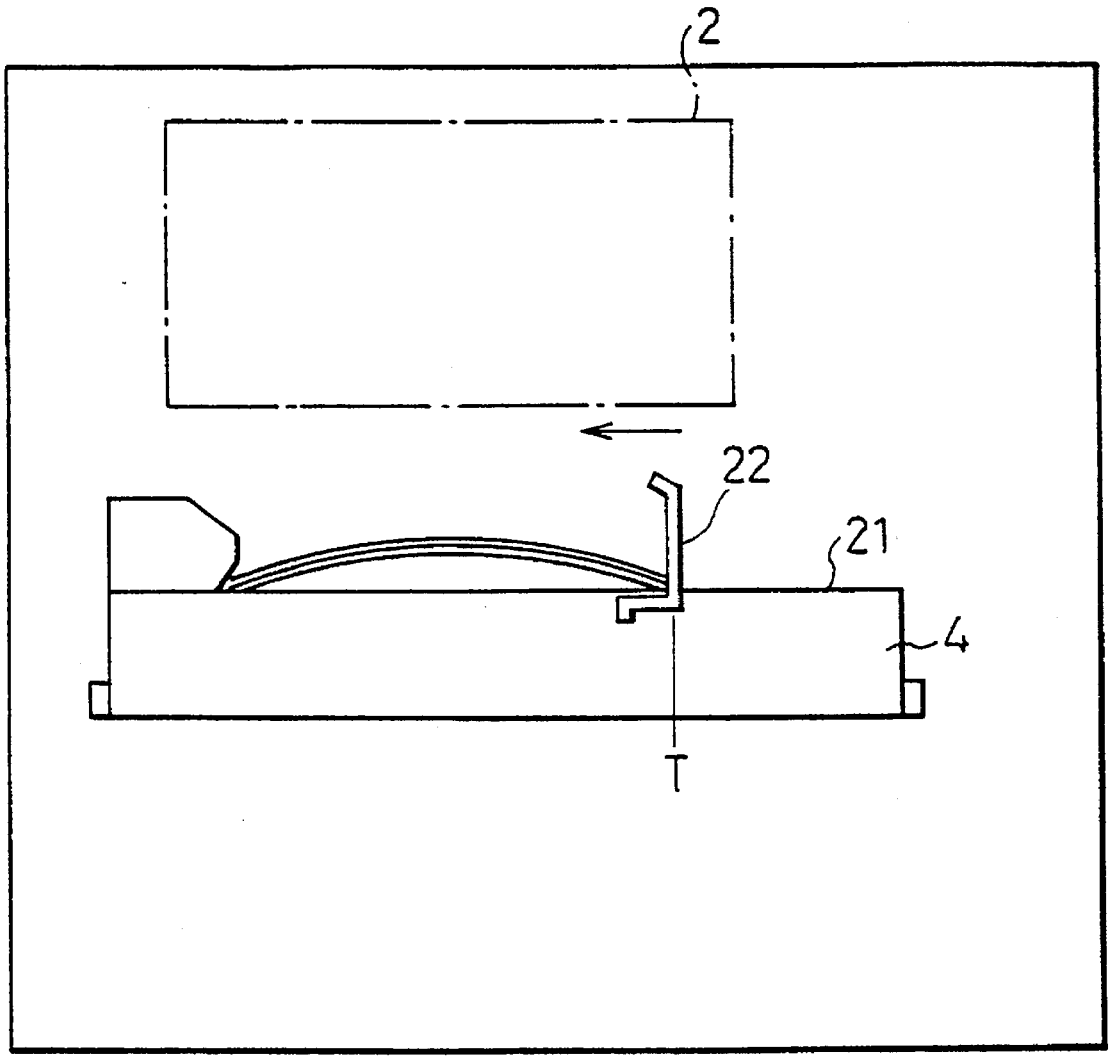
FIG. 4 is an explanatory drawing which shows the state that the movable backward end plate is moved by deforming sheets which stored on an ADU tray in the image forming apparatus.

In this case, as shown in FIG. 4, the movable backward end plate 22 is moved to the rest position "T" with the sheets being deformed on the storage table 21 of the ADU tray 4. After a jammed sheet is removed, when the copying is restatted, the movable backward end plate 22 is moved to the current position "P". At this time, the sheets recover its original state due to its own tension and weight. Therefore, a number and a size Of sheets which can be stored in the ADU tray 4 are limited to the range where the sheets recover its original state due to its own tension and dead weight, so the type of sheets is limited.

In the sheet feeder of the copying apparatus according to the present embodiment, when jam of a sheet occurs in the transporting path 5, the CPU 30 drives the pulse motor 24 according to the jam detecting signal from the jam sensor 13 so that the movable backward end plate 22 is moved to the non-interference section "B".

Therefore, when the paper guide 7 is converted from the close state to the open state in order to remove a jammed sheet, the movable backward end plate 22 of the ADU tray 4 is in the non-interference section "B". For this reason, since nothing hinders the paper guide 7 from moving, the paper guide 7 is converted from the close state to the open state without difficulty, thereby making it possible to take out a jammed sheet easily.

As a result, even if the ADU tray 4 is provided to the position where the movable backward end plate 22 of the ADU tray 4 interferes with the paper guide 7, the paper guide 7 can be brought to the open state. Therefore, the size of the main body 1 can be small, and thus its cost can be decreased.

In addition, in order to prevent the contact between the paper guide 7 and the movable backward end plate 22, it is sufficient to change only software. Therefore, additional parts are not required, and thus the arrangement does not become complicated.

In the above embodiment, the rest position "T" of the movable backward end plate 22 is set to an arbitrary position in the non-interference section "B", but the rest position "T" is not necessarily limited to this. When sheets exist on the ADU tray 4, for example, the rest position "T" can be controlled according to the size of the sheets so that the sheets are not deformed in the non-interference section "B".

Figure 5:
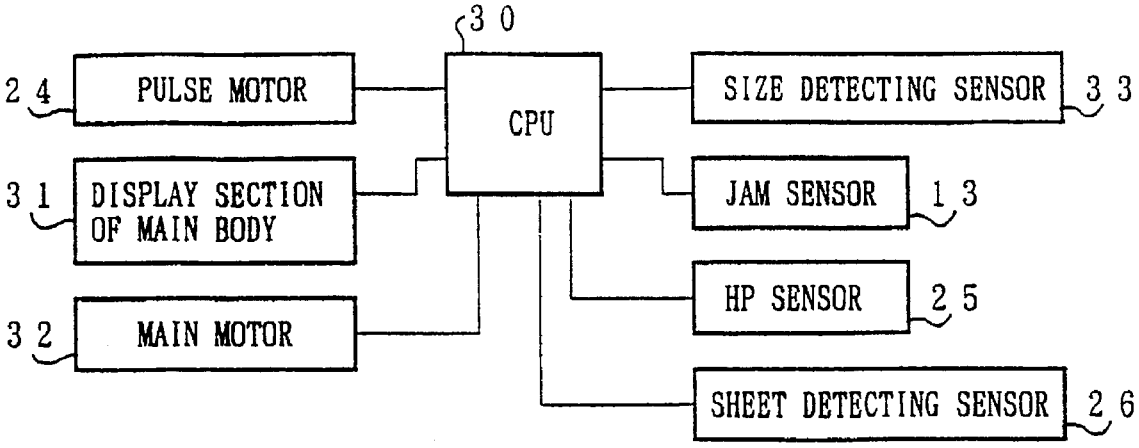
FIG. 5 is a block diagram which shows the constitution of the control section which moves the movable backward end plate in the case where sheets are stored on the ADU tray.
Figure 6:
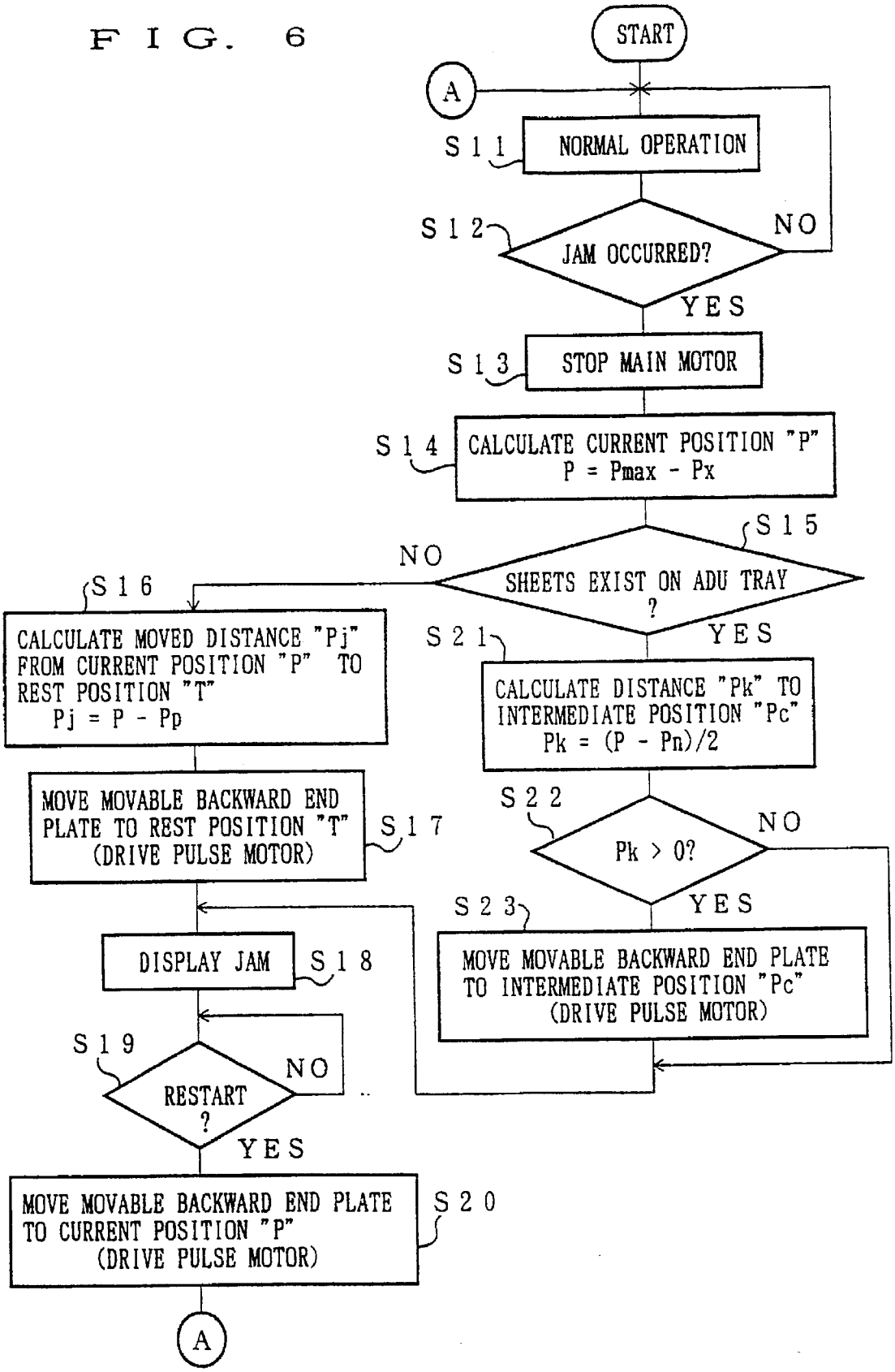
FIG. 6 is a flow chart which shows control for moving the movable backward end plate in the case where sheets are stored on the ADU tray.

In the case where the above control is exercised, as shown in FIG. 5, the sheet detecting sensor 26 as sheet detecting means in the ADU tray 4 Judges as to whether sheets exist on the ADU tray 4, and the size detecting sensor 33 detects a sheet size. Then, the CPU 30 controls the movement of the movable backward end plate 22. The following describes this control in reference to the flow chart shown in FIG. 6.

When jam occurs during the usual operation, the CPU 30 stops the main motor 32 so as to calculate the current position "P" (S11 through S14) in the same sequence shown in the flow chart of FIG. 3 (S1 through S4).

The sheet detecting sensor 26 judges as to whether the sheets exist on the ADU tray 4 (S15). When the sheets do not exist on the ADU tray 4, the CPU 30 calculates a moved distance "Pj" between a current position "P" and a rest position "T" in the non-interference section "B" (S16) in the same sequence shown in the flow chart of FIG. 3 (S5 through S9). Then the CPU 30 moves the movable backward end plate 22 from the current position "P" to the rest position "T" in the non-interference section "B" (S17), and displays occurrence of jam on the main body display section 31 (S18). After a jammed sheet is removed, the CPU 30 judges as to whether the operation can be restarted (S19), and when it judges that the operation can be restarted, the CPU 30 moves back the movable backward end plate 22 to the current position "p" (S20).

Meanwhile, when sheets exist on the ADU tray 4 at S15, the CPU 30 calculates a distance "Pk" from the current position "P" to an intermediate position "Pc" between the current position "P" and a boundary position "Pn" of the interference section "A" and the non-interference section "B" (S21). In other words, the distance "Pk" is calculated as follows:

$$Pk=(P-Pn)/2.$$

Thereafter, the CPU 30 Judges as to whether the distance "Pk" is positive (S22), and if the distance "Pk" is positive, namely, the current position "P" is within the non-interference section "B", the CPU 30 drives the pulse motor 24 so as to move the movable backward end plate 22 to the intermediate position "Pc" (S23). Then, the sequence moves to S18, and occurrence of jam is displayed.

Meanwhile, when the distance "Pk" is negative at S22, the current position "P" is within the interference section "A", and sheets cover the non-interference section "B". Therefore, the CPU 30 does not move the movable backward end plate 22 and the sequence returns to S18 so that the CPU 30 displays occurrence of jam. Thereafter, for example, the user opens the paper guide 7 so that it does not contact with the movable backward end plate 22 in the interference section "A" and removes a jammed sheet, or the user manually drives the transporting rollers 6 by using a knob, not shown, mounted to the transporting rollers 6 so that a jammed sheet is discharged out of the main body 1. When the operation can be restarted (S19), the CPU 30 moves back the movable backward end plate 22 to the current position "P".

As mentioned above, after the sheet detecting sensor 26 detects as to whether sheets exist on the ADU tray 4 and the size detecting sensor 33 detects a sheet size, the movable backward end plate 22 is moved, thereby making it possible to move the movable backward end plate 22 without deforming sheets on the ADU tray 4 and to convert the paper guide 7 to the open state. Moreover, since the sheets are not deformed, it is not necessary to press the movable backward end plate 22 against the sheets forcibly. This prevents load of the pulse motor 24 from becoming heavy, thereby making it possible to prevent the capacity of the pulse motor 24 from becoming larger.

[EMBODIMENT 2]

Figure 7:
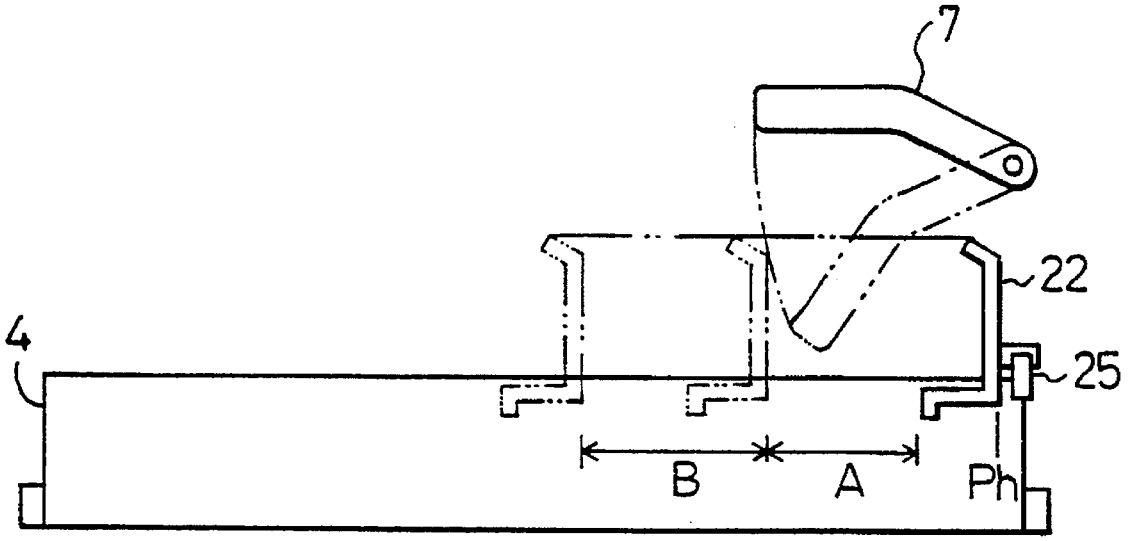
FIG. 7 is an explanatory drawing which shows the state where the movable backward end plate is moved to a home position which is a non-interference section in an image forming apparatus according to another embodiment of the present invention.
Figure 8:
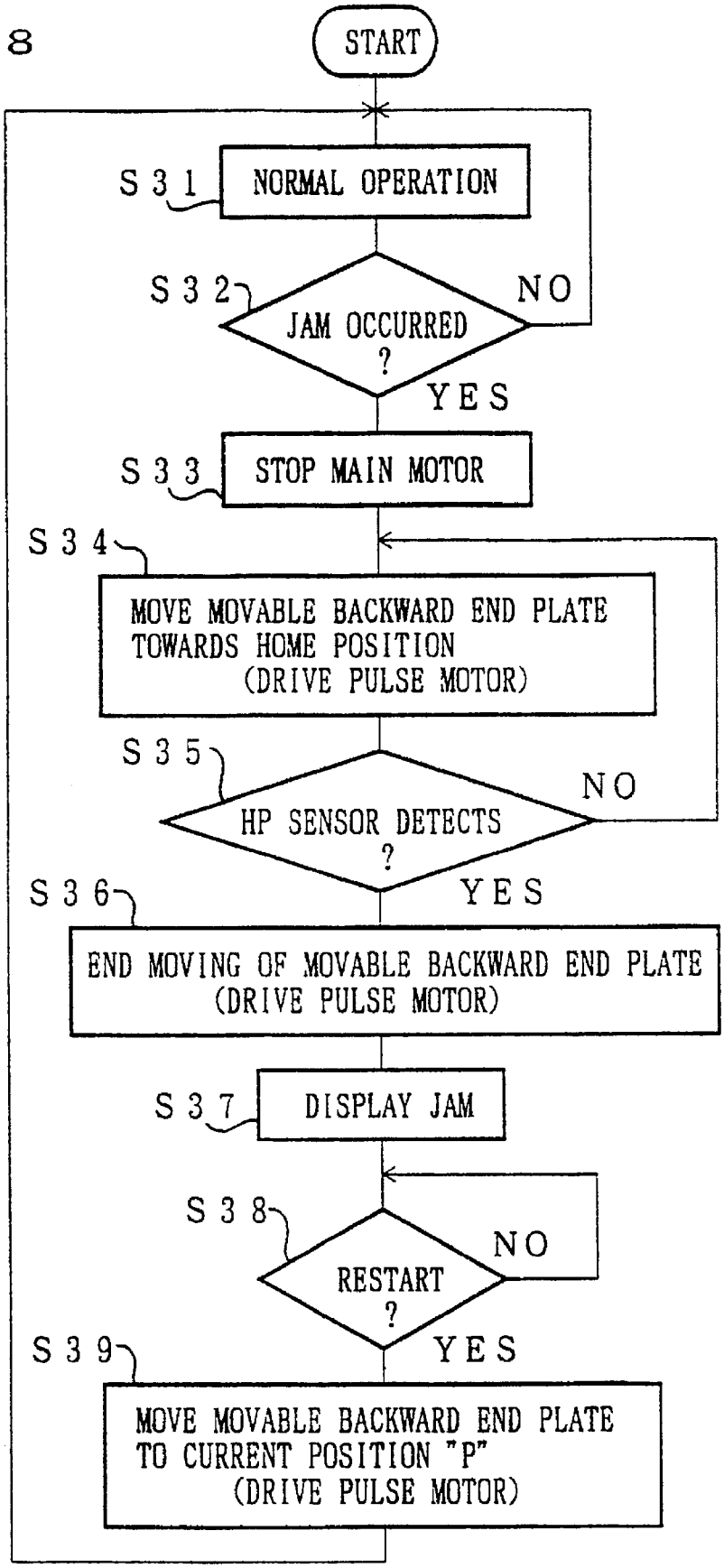
FIG. 8 is a flow chart which shows control for moving the movable backward end plate to the home position which is the non-interference section.

The following describes another embodiment of the present invention in reference to FIGS. 7 and 8. Here, for convenience of explanation, those members that have the same arrangement and functions, and that are described in the aforementioned embodiment 1 are indicated by the same reference numerals and the description thereof is omitted.

In the sheet feeder of the aforementioned embodiment, even in the case where the movable backward end plate 22 is moved to the home position "Ph", when the paper guide 7 is converted to the open state, it contacts with the movable backward end plate 22. On the contrary, as shown in FIG. 7, when the movable backward end plate 22 is in the home position "Ph", the paper guide 7 does not contact with the movable backward end plate 22 occasionally, namely, the movable backward end plate 22 is in the non-interference section. In other words, the home position "Ph" can be formed in the non-interference section occasionally. In this case, when jam occurs, the CPU 30 can move the movable backward end plate 22 to the home position "Ph" unconditionally.

The above control is described in reference to the flow chart shown in FIG. 8.

When jam occurs during the usual operation, the CPU 30 stops the main motor 32 (S31 through S33) in the same sequence shown in the flow chart of embodiment 1 (S1 through S3).

Thereafter, the CPU 30 drives the pulse motor 24 so as to move the movable backward end plate 22 towards the home position (S34), and the HP sensor 25 as home position detecting means judges as to whether the movable backward end plate 22 reaches the home position "Ph" (S35). Just when the movable backward end plate 22 gets to the home position "Ph", the CPU 30 stops the pulse motor 24 (S36).

Then, the CPU 30 displays occurrence of jam on the main body display section 31 (S37).

As a result, when removing a jammed sheet, the user can convert the paper guide 7 to the open state so that it does not contact with the movable backward end plate 22.

Thereafter, the CPU 30 judges as to whether the operation can be restarted after removal of the jammed sheet (S38), and when judging that the operation can be restarted, the CPU 30 moves the movable backward end plate 22 to the current position "P" (S39).

The sheet feeder in the copying apparatus of the present embodiment is arranged so that the movable backward end plate 22 is provided outside a position correspondingly to a maximum size of sheets, which can be stored on the ADU tray 4 and in the vicinity of the paper guide 7, and its home position "Ph" is in the non-interference section. In other words, in order to provide the movable backward end plate 22 in the non-interference section, a gap in the direction of height between the paper guide 7 and the ADU tray 4 should be slightly enlarge, and the home position "Ph" should be set in the vicinity of the supporting point 8 of the paper guide 7. Moreover, the HP sensor 25 can detect as to whether the movable backward end plate 22 reaches the home position "Ph".

As a result, the movable backward end plate 22 is moved to the home position "Ph" so that the paper guide 7 can be brought to the open state.

In addition, in the method for moving the movable backward end plate 22 to the non-interference section "B" according to a size of sheets on the ADU tray 4, a judgement should be made for a lot of conditions, so control becomes complicated. In particular, when the size of sheets becomes larger, the non-interference section "B" becomes narrower or occasionally disappears.

However, in the present embodiment, the movable backward end plate 22 is easily moved to the non-interference section so that the paper guide 7 can be brought to the open state without complicated control irrespective of a sheet size. In other words, since signals of the sheet detecting sensor 26 and the size detecting sensor 33 are not required, the operation does not depend upon an electrostatic noise and breakdowns of the sheet detecting sensor 26 and the size detecting sensor 33.

[EMBODIMENT 3]

Figure 9:
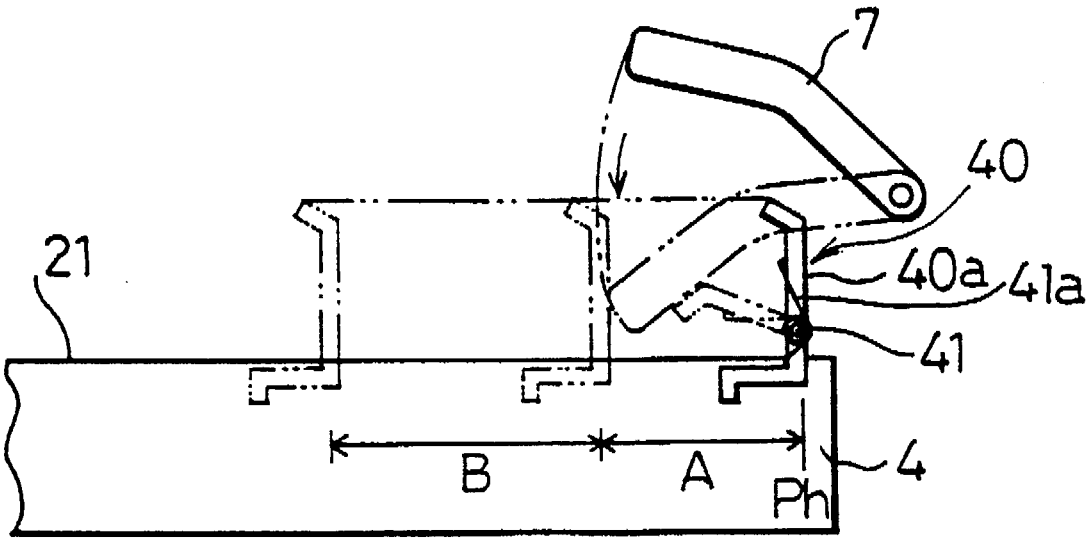
FIG. 9 shows a main part of an image forming apparatus according to still another embodiment of the present invention and is constitutional drawing which shows a movable backward end plate which can be bent.
Figure 10:
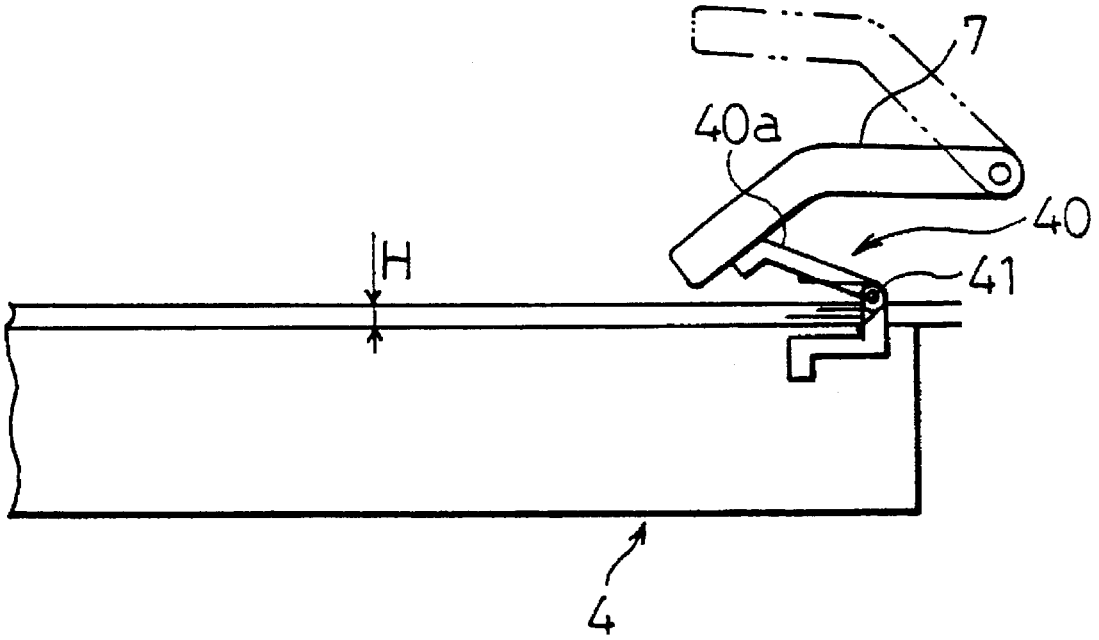
FIG. 10 is a constitutional drawing which shows the movable backward end plate which is formed so that its bending height becomes higher than the maximum sheet storing height in the image forming apparatus.

The following describes still another embodiment of the present invention in reference to FIGS. 9 and 10. Here, for convenience of explanation, those members that have the same arrangement and functions, and that are described in the aforementioned embodiments 1 and 2 are indicated by the same reference numerals and the description thereof is omitted.

In the aforementioned embodiments 1 and 2, the image forming apparatus is arranged so that when jam occurs, the movable backward end plate 22 is automatically moved to the non-interference section "B" of the paper guide 7 by the CPU 30. However, in accordance with such an arrangement, when the power source is off or the CPU 30 is broken down, for example, the movable backward end plate 22 cannot be moved, so the movement of the paper guide 7 is prevented.

Therefore, in the sheet feeder of the present embodiment, as shown in FIG. 9, a rotary axis 41 is provided to the vicinity of the surface of the storage table 21 on a movable backward end plate 40 as a sheet regulating member. As a result, the bending portion 40*a* of the movable backward end plate 40 can be rotated so as to be bent.

This makes it possible to convert the paper guide 7 to the open state in the interference section "A" between the paper guide 7 as a sheet guiding member and the movable backward end plate 40 so that the open state is same or approximately same as in the non-interference section "B".

In addition, when the paper guide 7 is converted to the open state, the paper guide 7 presses against the top of the movable backward end plate 40, and thus the movable backward end plate 40 is bent. Namely, the movable backward end plate 40 can be bent by following the movement of the paper guide 7 to the open state. Moreover, as shown in FIG. 9, since the rotary axis 41 is provided with a kick spring 41*a*, when the paper guide 7 is converted back to the close state, the movable backward end plate 40 automatically returns to the standing-up state due to elasticity of the kick spring 41*a*.

In the sheet feeder in the copying apparatus of the present embodiment, since the movable backward end plate 40 can be freely bent, even when the movable backward end plate 40 is in the interference section "A", obstruction of the movement of the paper guide 7 can be removed by bending the movable backward end plate 40. As a result, the paper guide 7 can be brought to the open state which is same or approximately same as in the non-interference section "B".

Therefore, since the ADU tray 4 can be provided to the position where the movable backward end plate 40 interferes with the paper guide 7 on the ADU tray 4 as an intermediate tray, the size of the main body 1 can be small, thereby making it possible to lower its cost.

In addition, even if the power source is off or the CPU, etc. is broken down, the movable backward end plate 40 can be freely bent. Therefore, jam can be securely removed without damaging the movable backward end plate 40.

Here, the present invention is not necessarily limited to the above embodiment, so various changes can be added to the present invention within the scope of the present invention. For example, in the present embodiment, the rotary axis 41 of the movable backward end plate 40 is provided in the vicinity of the surface of the storage table 21, but as shown in FIG. 10, it can be provided to a higher position than the height "H" of a maximum number of sheets stored on the ADU tray 4.

For example, if a thickness of a sheet is 0.1 mm and a maximum number of sheets stored on the ADU tray 4 is 50, the height "H" of the maximum number of stored sheets becomes 5 mm. Therefore, the rotary axis 41 can be provided, for example, 10 mm above the surface of the storage table 21. Even in the above arrangement, the paper guide 7 can be opened in a state which is similar to the open state.

As a result, the sheets on the ADU tray 4 can be prevented from damaging when the movable backward end plate 40 is bent, and the paper guide 7 can be brought to the open state with the storage state of sheets being held. Moreover, it can be prevented that the top of the paper guide 7 and the bending portion 40*a* of the movable backward end plate 40 contact with sheets and thus the movement of the movable backward end plate 40 and the paper guide 7 to a prescribed position becomes difficult.

[EMBODIMENT 4]

Figure 11:
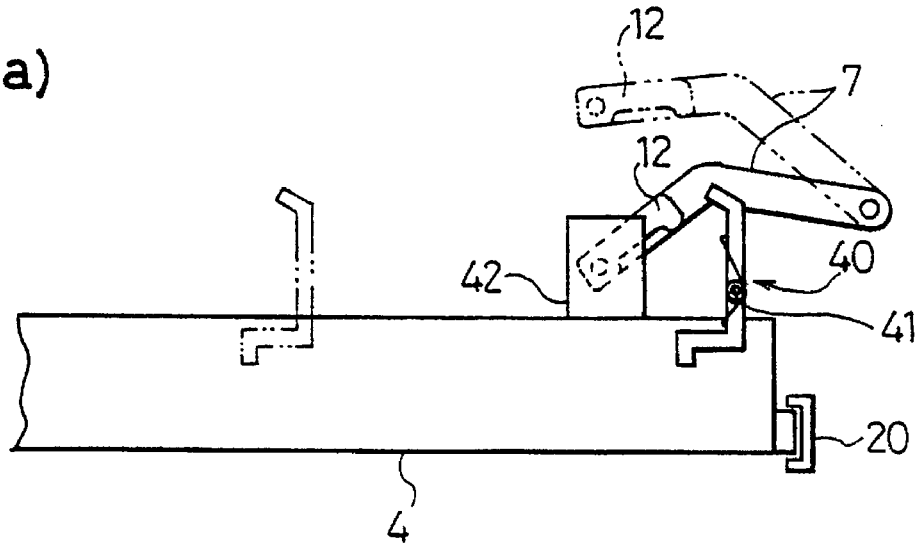
FIGS. 11(*a*) and 11(*b*) are constitutional drawings which show a mounting prevention plate for preventing the ADU tray, which can be freely pulled out, from being mounted in the image forming apparatus.
Figure 11:
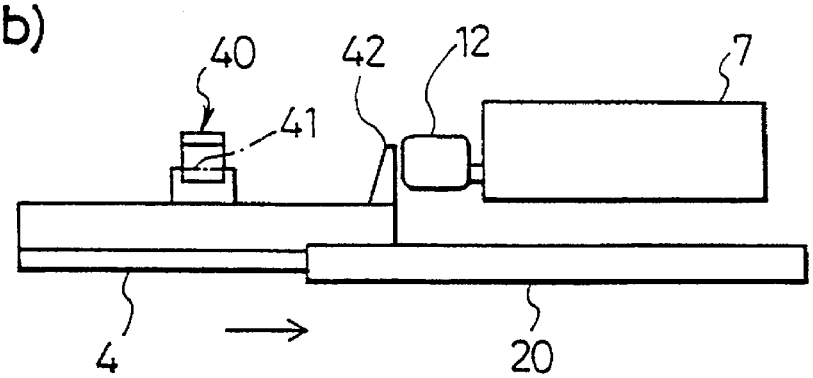
Figure 12A:
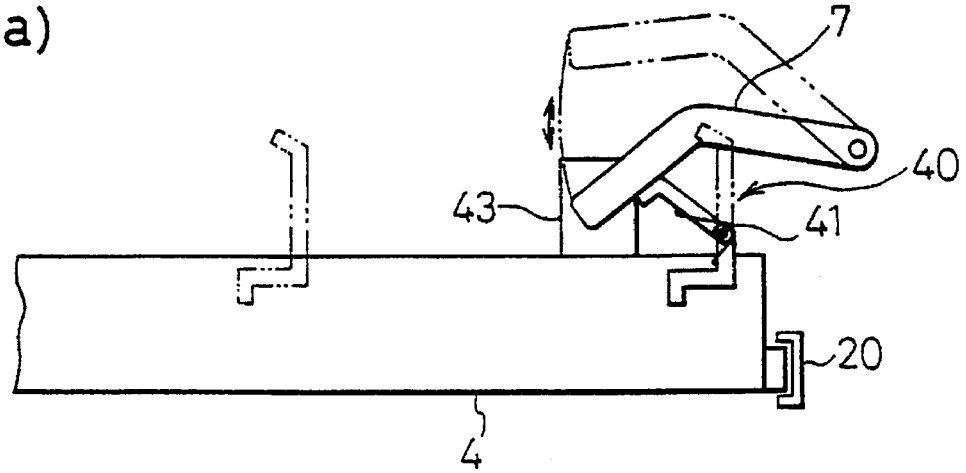
FIGS. 12(*a*) and 12(*b*) are constitutional drawings which show a pulling-out prevention plate for preventing the ADU tray, which can be freely pulled out, from being pulled out in the image forming apparatus.
Figure 12:
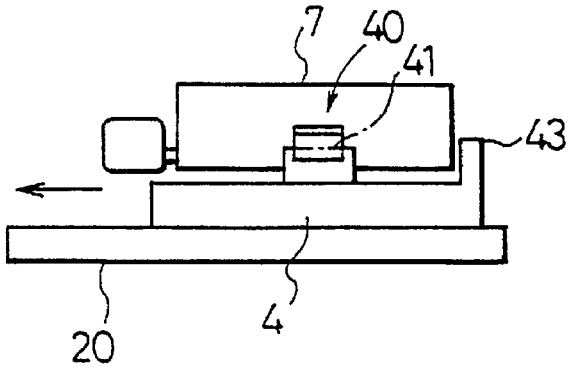
Figure 12:
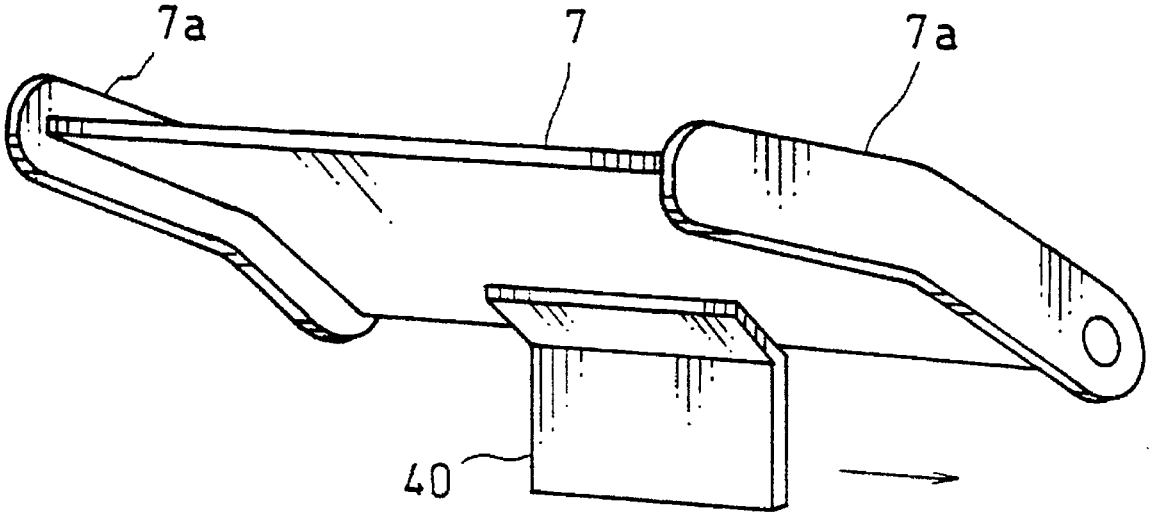
Figure 12:
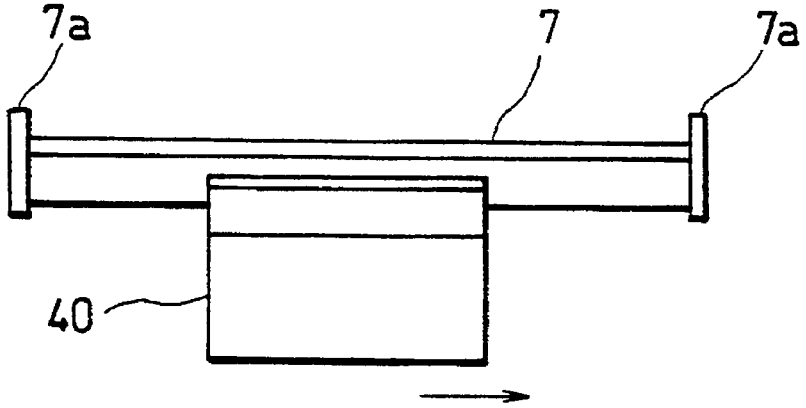
Figure 13:
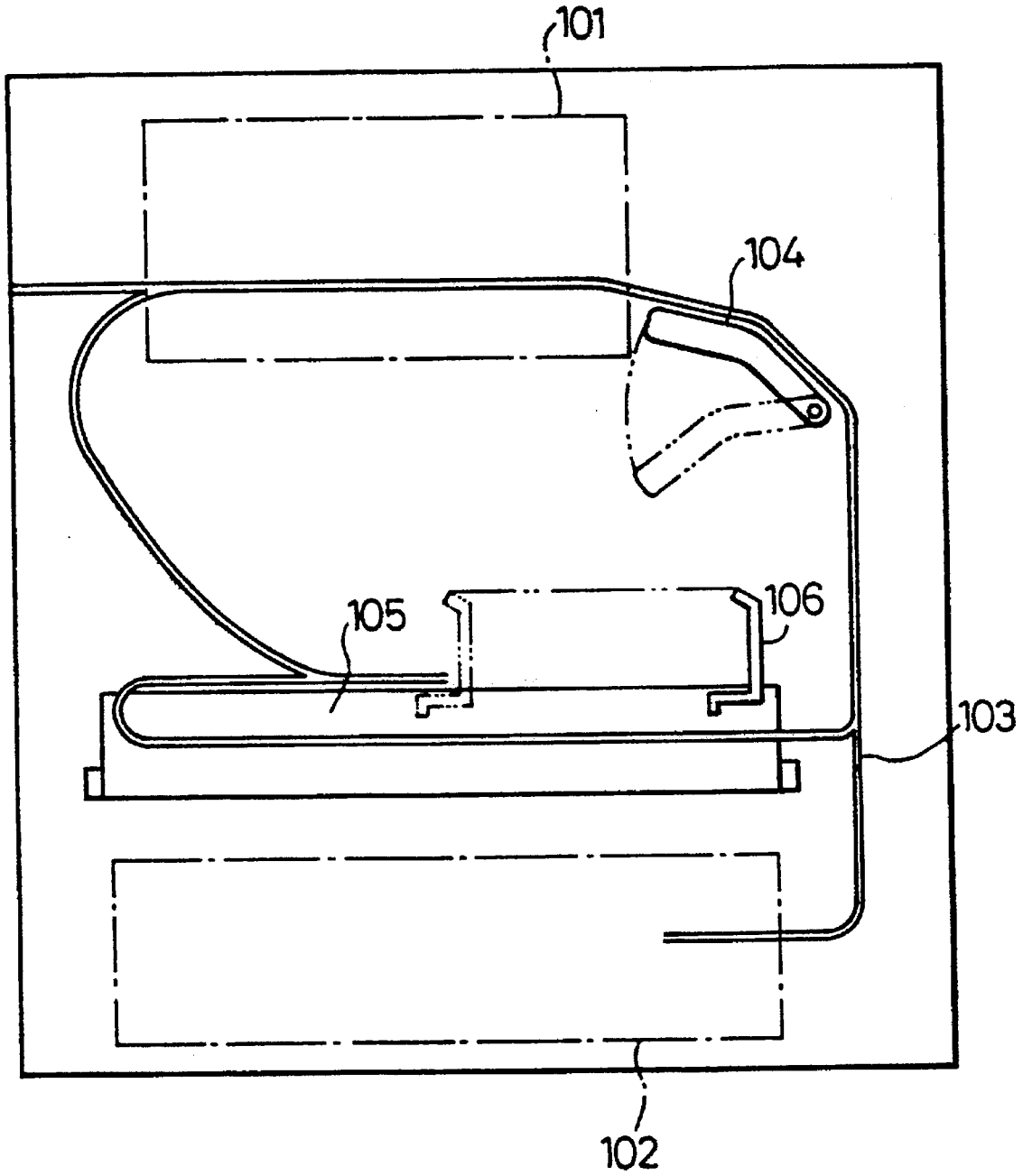
FIG. 13 PRIOR ART
FIG. 13 is a constitutional drawing which shows a copying apparatus as one example of a conventional image forming apparatus.
Figure 14:
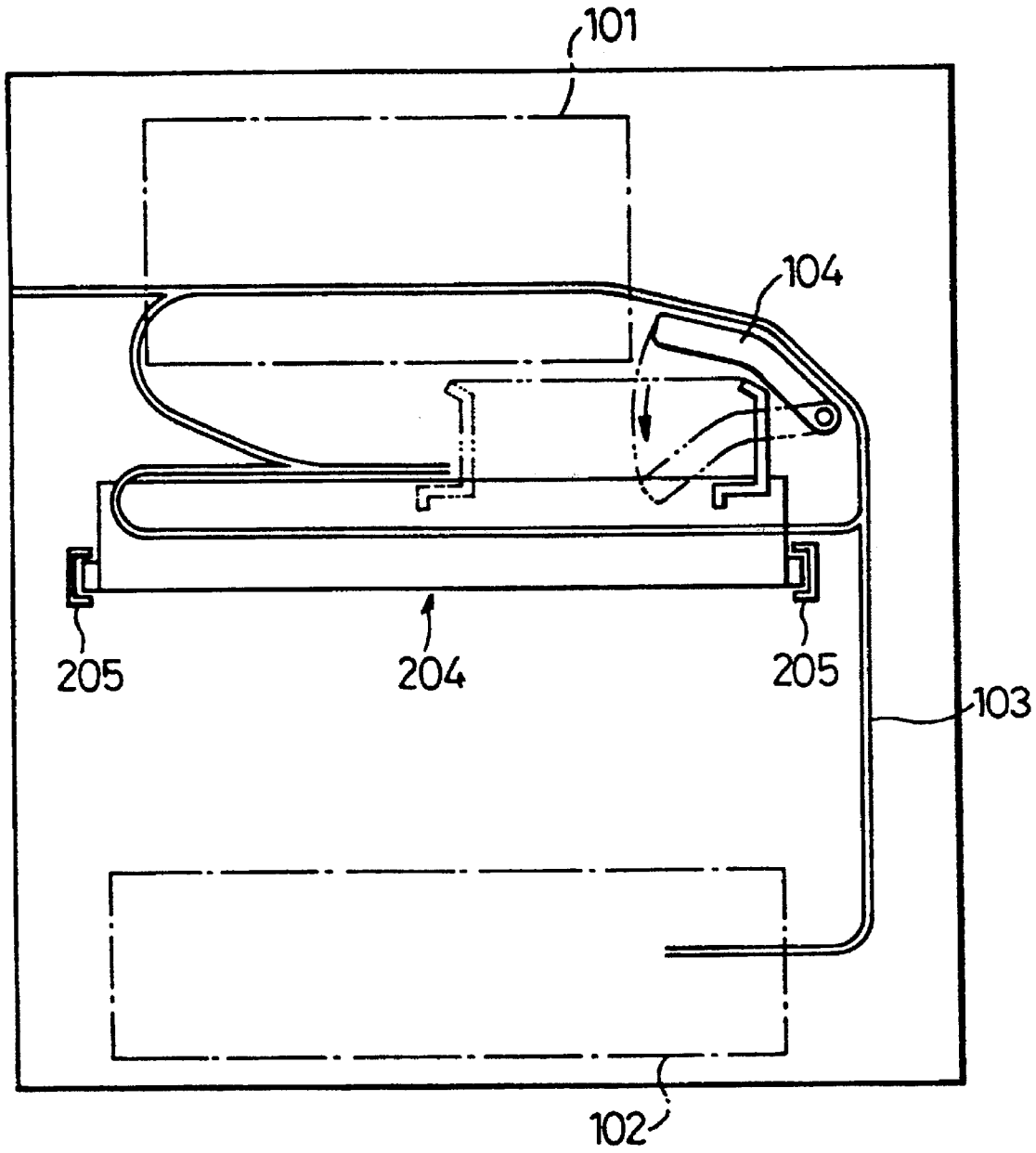
FIG.14 PRIOR ART
FIG. 14 shows another example of a conventional image forming apparatus and is an explanatory drawing which shows the state that a paper guide is in the open state after an ADU tray is pulled out.

The following describes still another embodiment of the present invention in reference to FIGS. 11 and 12. Here, for convenience of explanation, those members that have the same arrangement and functions, and that are described in the aforementioned embodiments 1 through 3 are indicated by the same reference numerals and the description thereof is omitted.

In accordance with the arrangement of the aforementioned embodiment 3, when the ADU tray 4 is pulled out with the paper guide 7 in the open state so that a jammed sheet is removed and the ADU tray 4 is again installed, the movable backward end plate 40 can be damaged due to contact between the movable backward end plate 40 and the paper guide 7.

Therefore, in order to prevent the damage of the movable backward end plate 40, as shown in FIGS. 11(*a*) and 11(*b*), a mounting prevention plate 42 as prohibition means can be provided to the end the ADU tray 4 on the paper guide 7 side.

The mounting prevention plate 42 is formed so as to contact with the lever 12 of the paper guide 7 when the paper guide 7 is converted to the open state. Therefore, when the paper guide 7 is in the close state, the paper guide 7 does not contact with the mounting prevention plate 42 at all.

As a result, when the ADU tray 4 is mounted, the mounting prevention plate 42 contacts with the lever 12 of the paper guide 7 and this prevents insertion of the ADU tray 4. As a result, the movable backward end plate 40 does not contact with the paper guide 7. For this reason, the movable backward end plate 40 can be prevented from damaging.

In addition, in order to ensure safety of the movable backward end plate 42, the ADU tray 4 can be arranged so as not to be pulled out when the paper guide 7 is in the open state.

In order to achieve the above arrangement, as shown in FIGS. 12(*a*) and 12(*b*), for example, a pulling-out prevention plate 43 as prohibition means may be provided to the end 7 side of the ADU tray 4 on the paper guide 7 side. Here, the pulling-out prevention plate 43 is not necessarily provided to the innermost of the ADU tray 4, so may be provided beyond the movable backward end plate 40. Moreover, the height of the pulling-out prevention plate 43 is such that it contacts with the paper guide 7 when the paper guide 7 is in the open state. Therefore, when the paper guide 7 is in the close state, the pulling-out prevention plate 43 does not contact with the paper guide 7 at all, so the ADU tray 4 can be pulled out without any problem.

As a result, when the ADU tray 4 is tried to pull out with the paper guide 7 in the open state, the pulling-out prevention plate 43 contacts with the side of the paper guide 7, thereby preventing the ADU tray 4 from further pulling out. As a result, the damage of the movable backward end plate 40 can be prevented.

In other words, as shown in FIGS. 12(*c*) and 12(*d*), small frames 7*a* and 7*a* for improving strength are provided to both the end of the paper guide 7. Therefore, when the ADU tray 4 is pulled out with the paper guide 7 in the open state, the movable backward end plate 40 contacts with the frame 7*a* and thus the frame 7*a* is damaged. However, in the present embodiment, the the pulling-out prevention plate 43 prevents the ADU tray 4 from being pulled out, thereby making it possible to prevent the movable backward end plate 40 from being damaged.

When the ADU tray is pulled out or mounted, the movable backward end plate 40 may contact with the paper guide 7 and thus those members can be damaged. However, in the present embodiment, since the mounting prevention plate 42 and the pulling-out prevention plate 43 as prohibition means prohibits the ADU tray 4 from being pulled out or mounted, damage to the movable backward end plate 40 and the paper guide 7 can be prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus for forming a plurality of images on a sheet, comprising:

an image forming section for forming an image on a sheet;

a transporting path where sheets are transported;

jam detecting means for detecting occurrence of jam of sheets in said transporting path;

a sheet guiding member which can be switched between a close state that guides sheets transported through said transporting path to said image forming section and an open state that make a jammed sheet removable in said transporting path, said sheet guiding member composing a part of said transporting path;

an intermediate tray for temporarily storing the sheets discharged from said image forming section so that the sheets pass through said transporting path and are transported to the image forming section again;

a sheet regulating member which is provided perpendicular to said intermediate tray so that a position of the stored sheets are regulated according to the size of the sheets, said sheet regulating member capable of moving between an interference section where it contacts with said sheet guiding member in the open state and a non-interference section where it does not contact with said sheet guiding member in the open state;

moving means for moving said sheet regulating member to the regulated position according to the size of the sheet; and interference control means for controlling said moving means based upon a jam detecting signal from said jam detecting means so as to move said sheet regulating member from the regulated position to the non-interference section.

2. The image forming apparatus as defined in claim 1, further comprising:

home position detecting means for detecting as to whether said sheet regulating member is in its home position, wherein said home position is set outside the position according to a maximum size of sheets stored on said intermediate tray and is set within the non-interference section, wherein said interference control means moves said sheet regulating member to the home position based upon a result of detection by said home position detecting means.

3. The image forming apparatus as defined in claim 1, wherein said sheet guiding member is capable of switching between the close state and the open state by rotating it.

4. The image forming apparatus as defined in claim 1, wherein said sheet regulating member is capable of moving in the direction where sheets are transported.

5. The image forming apparatus as defined in claim 1, further comprising:

sheet detecting means for detecting that sheets are stored on said intermediate tray, wherein said interference control means prohibits said sheet regulating member from moving toward the sheets on said intermediate tray based upon a sheet detecting signal from said sheet detecting means.

6. The image forming apparatus as defined in claim 1, wherein when said sheet guiding member is again switched to the close state after a jammed sheet is removed, said interference control means moves said sheet regulating member to the regulated position.

7. The image forming apparatus as defined in claim 1, further comprising display means for displaying that a sheet is jammed after said interference control means is controlled according to the jam detecting signal.

8. An image forming apparatus for forming a plurality of images on a sheet, comprising:

an image forming section for forming an image on a sheet;

a transporting path where sheets are transported;

a sheet guiding member which can be switched between a close state that guides sheets transported through said transporting path to said image forming section and an open state that make a jammed sheet removable in said transporting path, said sheet guiding member composing a part of said transporting path;

an intermediate tray for temporarily storing the sheets discharged from said image forming section so that the sheets pass through said transporting path and are transported to said image forming section again; and a sheet regulating member which is movably provided perpendicular to said intermediate tray so that a position of the stored sheets are regulated according to the size of the sheets, said sheet regulating member contacting with said sheet guiding member in the open state at least in a part of its moving area, wherein said sheet regulating member can be bent so as to remove obstruction of the movement of the sheet guiding member.

9. The image forming apparatus as defined in claim 8, further comprising:

jam detecting means for detecting that sheets are jammed in said transporting path; and moving means for moving said sheet regulating member to the regulated position according to the size of sheets, wherein said sheet regulating member is capable of moving between an interference section where it contacts with said sheet guiding member in the open state and a non-interference section where it does not contact with said sheet guiding member in the open state.

10. The image forming apparatus as defined in claim 8, wherein:

said sheet guiding member is capable of switching between the close state and the open state by rotating it about a supporting point as a rotary axis which is parallel with a surface of a transporting sheet and perpendicular to the sheet transporting direction, said sheet regulating member is a movable backward end plate which can be bent on its rotary axis which is parallel with the above rotary axis.

11. The image forming apparatus as defined in claim 8, wherein said sheet regulating member can be bent on a position which is higher than the top surface of sheets, which can be maximumly stored on said intermediate tray.

12. The image forming apparatus as defined in claim 8, wherein said sheet regulating member is released from contact with said sheet guiding member, it can automatically return to the original standing-up state.

13. The image forming apparatus as defined in claim 8, wherein said intermediate tray can be freely pulled out, said image forming apparatus, further comprising prohibition means for prohibiting said intermediate tray from being pulled out or mounted when said sheet guiding member is in the open state.

14. An image forming apparatus for forming a plurality of images on sheets, comprising:

an image forming section for forming an image on sheets;

a transporting path where sheets are transported;

a sheet guiding member which can be switched between a close state that guides sheets transported through said transporting path to said image forming section and an open state that make a jammed sheet removable in said transporting path, said sheet guiding member composing a part of said transporting path;

an intermediate tray for temporarily storing the sheets discharged from said image forming section so that the sheets pass through said transporting path and are transported to the image forming section again; said intermediate tray being freely pulled out;

a sheet regulating member for regulating a position of the stored sheets according to the size of the sheets, said sheet regulating member being provided perpendicular to said intermediate tray so that it is movable and that it contacts with said sheet guiding member in the open state at least in a part of its moving area; and prohibition means for prohibiting said intermediate tray from being pulled out or mounted when said sheet guiding member is in the open state.

15. The image forming apparatus as defined in claim 14, wherein said prohibition means is a mounting prevention plate which is provided perpendicular to said intermediate tray so that it contacts with said sheet guiding member in the open state when said intermediate tray is mounted.

16. The image forming apparatus as defined in claim 14, said prohibition means is a pulling-out prevention plate which is provided perpendicular to the intermediate tray so that it contacts with said sheet guiding member in the open state when said intermediate tray is pulled out.

* * * * *